US007201008B2

(12) United States Patent
Lifson et al.

(10) Patent No.: US 7,201,008 B2
(45) Date of Patent: Apr. 10, 2007

(54) VAPOR COMPRESSION SYSTEM PERFORMANCE ENHANCEMENT AND DISCHARGE TEMPERATURE REDUCTION IN THE UNLOADED MODE OF OPERATION

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 331 days.

(21) Appl. No.: 10/429,359

(22) Filed: May 5, 2003

(65) Prior Publication Data

US 2004/0221591 A1 Nov. 11, 2004

(51) Int. Cl.

| | |
|---|---|
| ***F25B 41/00*** | (2006.01) |
| ***F25B 49/00*** | (2006.01) |
| ***F25B 7/00*** | (2006.01) |
| ***F25B 41/04*** | (2006.01) |

(52) U.S. Cl. ..... 62/196.2; 62/175; 62/196.1; 62/196.3; 62/225; 62/226; 62/228.1; 62/228.3

(58) Field of Classification Search ..... 62/175, 62/196.1–196.3, 225, 226, 228.1, 228.3, 62/510

See application file for complete search history.

(56) References Cited

U.S. PATENT DOCUMENTS

| | | | | |
|---|---|---|---|---|
| 4,102,150 | A * | 7/1978 | Kountz | 62/209 |
| 4,324,105 | A * | 4/1982 | Cann | 62/196.2 |
| 6,418,740 | B1 | 7/2002 | Williams et al. | |
| 6,715,304 | B1 * | 4/2004 | Wycoff | 62/155 |
| 6,718,781 | B2 * | 4/2004 | Freund et al. | 62/199 |
| 6,769,264 | B2 * | 8/2004 | Moon et al. | 62/204 |
| 2004/0206110 | A1 * | 10/2004 | Lifson et al. | 62/498 |

FOREIGN PATENT DOCUMENTS

| | | |
|---|---|---|
| GB | 2 068 522 A | 8/1981 |
| GB | 2 246 852 A | 2/1992 |
| JP | 62 196555 A | 8/1987 |
| JP | 02 275079 | 11/1990 |
| JP | 04 028961 A | 1/1992 |
| JP | 11 324951 A | 11/1999 |
| JP | 20 02285971 | 10/2002 |
| WO | WO 95/21359 A | 8/1995 |

* cited by examiner

*Primary Examiner*—Cheryl Tyler
*Assistant Examiner*—B. Clayton McCraw
(74) *Attorney, Agent, or Firm*—Bachman & LaPointe, P.C.

(57) ABSTRACT

A vapor compression system includes a main vapor compression circuit having a compressor, a condenser, an expansion device and an evaporator serially connected by main refrigerant lines, the compressor having a suction port, a main discharge port and an intermediate port, and the main refrigerant lines being communicated with the main discharge port and the suction port; a bypass circuit communicated between the intermediate port and the suction portion; and a superheat sensing device positioned to sense superheat in a combined flow from the main vapor compression circuit and the bypass circuit. A method of operation of the system is also provided. The benefits of enhanced system and compressor performance, improved compressor reliability and extended system operating envelope are readily obtained.

6 Claims, 1 Drawing Sheet

VAPOR COMPRESSION SYSTEM PERFORMANCE ENHANCEMENT AND DISCHARGE TEMPERATURE REDUCTION IN THE UNLOADED MODE OF OPERATION

BACKGROUND OF THE INVENTION

The invention relates to vapor compression systems and, more particularly, to a system and method which allow for performance enhancement and discharge temperature reduction in an unloaded mode of operation of the vapor compression system.

Vapor compressor systems are widely used in air conditioning refrigeration and other applications, and involve a compressor, a condenser, an expansion device and an evaporator which serially treat refrigerant passed therethrough in a manner which is well known to a person of ordinary skill in the art.

It is further known that a vapor system with a bypass circuit can be used to direct a portion of refrigerant flow from an intermediate location along the compression process in the compressor back to the compressor inlet. This unloads the compressor, which is frequently desirable in non-peak demand conditions.

Although this unloading can help to provide more continuous and hence more efficient operation of the system, the need remains for further system efficiency improvement and it is the primary object of the present invention to provide same.

Another object of the present invention is to widen the compressor operating envelope and prevent nuisance system shut-downs as well as improve compressor reliability.

SUMMARY OF THE INVENTION

In accordance with the present invention, the foregoing objects and advantages have been readily attained.

According to the invention, a vapor compression system is provided which comprises a main vapor compression circuit comprising a compressor, a condenser, an expansion device and an evaporator serially connected by main refrigerant lines, said compressor having a suction port, a main discharge port and an intermediate port, and said main refrigerant lines being communicated with said main discharge port and said suction port; a bypass circuit communicated between said intermediate port and said suction portion; and a superheat sensing device positioned to sense superheat in a combined flow from said main vapor compression circuit and said bypass circuit.

In further accordance with the invention, a method for operating such a vapor compression system is provided which comprises the steps of sensing superheat in said combined flow, and operating at least one of said compressor and said expansion device based upon said sensing step.

In accordance with the invention, and advantageously, superheat fed to the suction port of the compressor, in a combined flow between the main circuits and bypass circuits, is detected such that over-heating of vapor at the compressor entrance can be avoided. This advantageously allows for more efficient operation of the compressor and overall system, and/or control of amount of superheat fed to the compressor, enhancement of overall system performance, widening of the system operating envelope and improvement in compressor reliability.

BRIEF DESCRIPTION OF THE DRAWINGS

A detailed description of preferred embodiments of the present invention follows, with reference to the attached drawing, wherein.

DETAILED DESCRIPTION

Figure 1:
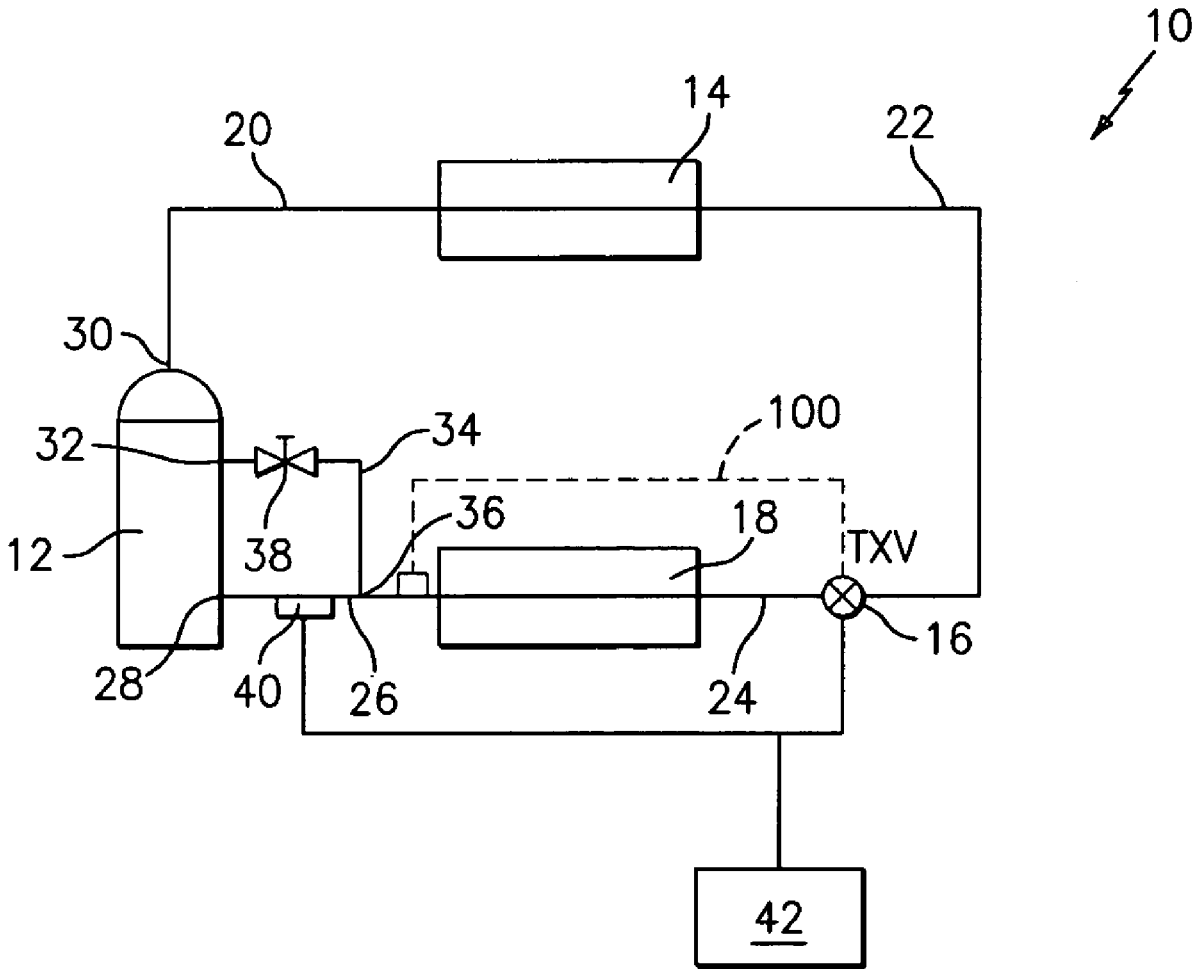
FIG. 1 schematically illustrates a system in accordance with the present invention.

The invention relates to a vapor compression system and, more particularly to a vapor compression system having a bypass circuit and being adapted to allow for specific control of superheat fed to the compressor.

Referring to FIG. 1, a vapor compression system 10 is shown having a compressor 12, a condenser 14, an expansion device 16 and an evaporator 18 which are serially connected by refrigerant lines including line 20 between compressor 12 and condenser 14, line 22 between condenser 14 and expansion device 16, line 24 between expansion device 16 and evaporator 18 and line 26 between evaporator 18 and compressor 12.

In this regard, compressor 12 has a suction port 28, a main discharge port 30 and an intermediate discharge port 32. As shown in the drawing, main refrigerant line 20 exits compressor 12 through main discharge port 30, and main refrigerant line 26 feeds to compressor 12 through suction port 28.

Such a system operates in a manner which is well known to a person of ordinary skill in the art, and which is therefore not further described herein.

In further accordance with the invention, a bypass circuit is provided which includes a bypass line 34 which is advantageously connected between intermediate port 32 and a bypass junction 36 which is positioned downstream of evaporator 18 and upstream of suction port 28, in this instance along line 26 as shown.

A bypass shutoff valve 38 is also positioned along bypass line 34 for use in controlling and/or substantially blocking flow through the bypass circuit.

Also as is known to a person of ordinary skill in the art, the bypass circuit can be activated through opening of bypass valve 38 so as to allow partially compressed refrigerant to be removed from compressor 12 and injected into suction port 28. This is referred to as operating in an unloaded condition, and is often desirable, for example, under circumstances of less than maximum or peak demands upon the system.

In accordance with the present invention, and advantageously, means are provided for determining refrigerant vapor superheat in a location which will carry a combined flow from both the main refrigerant circuit and the bypass circuit, if the circuit is active.

As shown in FIG. 1, this can be accomplished through provision of a superheat sensing device 40, advantageously located between bypass junction 36 and suction port 28 as shown. Device 40 can be operatively associated with expansion device 16 whereby operation of expansion device 16 can be controlled to adjust evaporator 18 whereby a desired level of superheat, for example including values close to zero superheat, can be fed to suction port 28 of compressor 12.

It has been understood that any expansion device, such as mechanical expansion devices, electronic expansion devices, etc. are suitable for this purpose, of course with conventional limitations of superheat control imposed on each of them. For instance, device 40 could be a bulb for the TXV or a sensor for EXV, as two examples.

In accordance with the invention, if desired, a control unit 42 can be provided and operatively associated with superheat sensing device 40 for receiving appropriate information as to levels of desired superheat in the combined flow.

Location of superheat sensing device 40 downstream of bypass junction 36, where flows from evaporator 18 and the bypass circuit are combined, allows for reduction of suction superheat entering the compressor during bypass unloaded mode of operation, when bypass valve 38 is opened.

Without the system of the present invention, superheat is conventionally measured at the evaporator exit upstream of the main and bypass flow junction as shown in dashed lines 100 in FIG. 1, and additional and unnecessary pre-heating of vapor can occur during a bypass mode of operation. This would occur as the relatively colder vapor stream leaving the evaporator mixes with the relatively hotter bypass stream from the intermediate pressure port of the compressor.

Stated differently, if the superheat is controlled to the same value sensing upstream of the bypass junction as in the prior art, and downstream of the bypass junction as in the current invention, the refrigerant vapor entering the compressor in the present invention will be at a colder temperature than the vapor temperature entering the compressor in the prior art. This occurs as the vapor superheat entering the compressor is higher than the vapor superheat at the evaporator exit, as the main refrigerant flow will be additionally preheated by mixing with the hotter bypass stream. Thus, the temperature of vapor in the present invention is lower than the vapor temperature in the prior art, since in this invention the vapor superheat is controlled downstream of the bypass junction. Further, provision and location of superheat sensing device 40 in accordance with the present invention will often result in a two-phase flow leaving the evaporator, which allows for more uniform temperature distribution across evaporator 18, thus enhancing operation of evaporator 18 as well.

This reduction in suction superheat to the compressor enhances overall system performance, and reduces discharge temperature of compressor 12 as desired, thereby widening the system operating envelope or range of operating conditions within which compressor 12 can be operated. Furthermore, due to cooler temperatures within the compressor, compressor efficiency and reliability are improved.

A further advantage of the system and method of the present invention is that incorporation of this system into existing systems required little or no hardware modification in most applications, and nevertheless provides desirable benefits for system performance.

It should be clear that a system and method have been provided in accordance with the present invention whereby system performance is enhanced and compressor discharge temperature is reduced in a bypass unloaded mode of operation of the system. Also, system efficiency as well as compressor reliability are improved.

Additionally, it should be noted that such modification of the system and relocation of superheat sensing device has no negative effect on the system performance in the conventional mode of operation.

It is to be understood that the invention is not limited to the illustrations described and shown herein, which are deemed to be merely illustrative of the best modes of carrying out the invention, and which are susceptible of modification of form, size, and arrangement of parts and details of operation. The invention rather is intended to encompass all such modifications which are within its spirit and scope as defined by the claims.

What is claimed is:

1. A vapor compression system, comprising:

a main vapor compression circuit comprising a compressor, a condenser, an expansion device and an evaporator serially connected by main refrigerant lines, said compressor having a suction port, a main discharge port and an intermediate port, and said main refrigerant lines being communicated with said main discharge port and said suction port;

a bypass circuit communicated between said intermediate port and said suction portion; and a superheat sensing device positioned to sense superheat in a combined flow from said main vapor compression circuit and said bypass circuit.

2. The system of claim 1, wherein said bypass circuit joins said main vapor compression circuit at a bypass junction downstream of said evaporator and upstream of said suction port, and wherein said superheat sensing device is positioned between said bypass junction and said suction port.

3. The system of claim 1, further comprising a control member communicated with said superheat sensing device and adapted to control operation of at least one of said compressor and said expansion device based upon information received from said superheat sensing device.

4. The system of claim 1, wherein said superheat sensing device is a device selected from the group consisting of TXV bulbs, pressure transducers, temperature transducers, and combinations thereof.

5. A method for operating a vapor compression system having a main vapor compression circuit comprising a compressor, a condenser, an expansion device and an evaporator serially connected by main refrigerant lines, said compressor having a suction port, a main discharge port and an intermediate port, and said main refrigerant lines being communicated with said main discharge port and said suction port; a bypass circuit communicated between said intermediate port and said suction portion; and a superheat sensing device positioned to sense superheat in a combined flow from said main vapor compression circuit and said bypass circuit, the method comprising the steps of sensing superheat in said combined flow, and operating at least one of said compressor and said expansion device based upon said sensing step.

6. The method of claim 5, further comprising the steps of selecting a desired level of superheat to be fed to said suction port, determining an actual level of superheat in said combined flow, and operating at least one of said compressor and said expansion device so as to provide said actual level of superheat corresponding substantially to said desired level.

* * * * *